US005729856A

United States Patent [19]

Jang et al.

[11] Patent Number: 5,729,856

[45] Date of Patent: Mar. 24, 1998

[54] SEMICONDUCTOR WAFER CLEANING APPARATUS

[75] Inventors: Dong-Heui Jang; Dong-Hyun Kim; Choung-Hee Kim; Se-Yeon Jang, all of Suwon, Rep. of Korea

[73] Assignee: Samsung Electronics Co. Ltd., Suwon, Rep. of Korea

[21] Appl. No.: 773,339

[22] Filed: Dec. 26, 1996

[30] Foreign Application Priority Data

Feb. 13, 1996 [KR] Rep. of Korea ..... 1996-3401

[51] Int. Cl.[6] ..... A46B 11/06

[52] U.S. Cl. ..... 15/88.1; 15/77

[58] Field of Search ..... 15/21.1, 77, 88.1, 15/88.2

[56] References Cited

U.S. PATENT DOCUMENTS 1,366,306 1/1921 Wick ..... 15/88.2

2,129,019 9/1938 Mulvihill ..... 15/88.2

5,421,056 6/1995 Tateyama ..... 15/77

*Primary Examiner*—Randall Chin

*Attorney, Agent, or Firm*—Jones & Volentine, L.L.P.

[57] ABSTRACT

A semiconductor wafer cleaning apparatus having an edge rinse member adapted for rinsing edges of a semiconductor wafer and having a moving member adapted to permit horizontally movement of the edge rinse member, wherein the apparatus is adapted to minimize or prevent an upper surface of the wafer from being stained with pollutants during rinsing. The wafer cleaning apparatus minimizes or prevents rebounding of a rinse solution containing particles from the inside wall of a bowl during rinsing of the edges of a semiconductor wafer.

10 Claims, 2 Drawing Sheets

SEMICONDUCTOR WAFER CLEANING APPARATUS

BACKGROUND OF THE INVENTION

1. Field of the Invention

The present invention relates to an apparatus useful in a process for fabricating a semiconductor device, and more particularly to a semiconductor wafer cleaning apparatus adapted to rinse the edges of a wafer and thereby enable the prevention of the occurrence of rebounding pollutants functioning as defects on the wafer.

2. Description of the Prior Art

Particles resulting from the process steps involved in the production of semiconductor devices may function as pollutants if allowed to remain on the surface of semiconductor wafers. In general, their presence in this environment can lead to the production of defective devices. This results in increased production costs in producing semiconductor devices. The presence of particles also functions as a restricting factor limiting the accuracy of production processes in microelectronic fabrication technology, particularly photolithography processes. Therefore, they exert an enormous influence on the yield or electrical characteristics of such semiconductor devices.

Well-known photolithographic processes comprise the steps of forming a photoresist film on a semiconductor wafer, exposing the photoresist to ultraviolet light through a pattern forming mask, developing the wafer by using a chemical to dissolve the unexposed portions of the photoresist film not to be cured, and inspecting the developed wafer. During an inspection of the developed wafer, if defective patterns are observed, the above described method must be carried out again.

In a stepper for photolithography, a wafer stage may become stained or polluted with particles which are introduced from the outside, and/or which are generated in the inside thereof. The wafer stage which is stained, or polluted, in such a manner causes the wafer to have a poor pattern at that location. Therefore, the presence of photoresist particles leads to making the stage defocus in the stepper which causes pattern defects.

In order to reduce the occurrence of defects in the wafer due to the externally introduced particles, it is necessary to rinse the edges of the wafer after the deposition of a photoresist film. This is because, during the formation of a photoresist film on a wafer, the photoresist film is deposited on all the exposed surfaces, including the edges of the wafer. Allowing the photoresist film to remain on the edges thereof contributes to occurrence of polluting photoresist particles. The friction between wafers in a wafer carrier or between a wafer and other solid objects produces the undesired photoresist film particles, and thus the wafer stage becomes stained with pollutants such as the particles. As a result, using the stepper with the stage stained would cause serious fabrication problems, such as an increase in the number of defects in a wafer produced thereby.

As shown in FIG. 1, in a prior art wafer cleaning apparatus, when a semiconductor wafer 1 with a photoresist film formed thereon is loaded and fixed on the vacuum chuck 2 through an opening of a bowl 4 (or a processing chamber), a rinse solution is injected (or sprayed) through a rinse solution injecting nozzle 3 on the edge of the upper surface of the wafer 1 in a manner intended to remove only photoresist material from the edges of the wafer. Most of an injected solution containing loose (removed) photoresist particles flows toward the bottom of the bowl 4 as shown by solid line arrow "a" shown in FIG. 1. However, the remaining solution containing removed photoresist particles is rebounded from the inside wall of the bowl 4 to land toward the central surface portion of the wafer 1 as shown by solid line arrow "b" in FIG. 1.

The amount of the rebounded solution therefrom depends on the cleaning conditions such as the injection pressure of the rinse solution to the nozzle 3, the number of rotations of the vacuum chuck 2, and the structure of the bowl 4. Further, it is very difficult to accurately adjust all of the above cleaning conditions in the prior art wafer cleaning apparatus. If any of the cleaning conditions is not adjusted accurately in the apparatus, photoresist on edges of the wafer can not be rinsed reliably. This results in a decrease in the uniform degree of the cleaning process due to the rebounded solution. Therefore, it is difficult or impossible to expect dependable and reliable cleaning processes while utilizing the prior art wafer cleaning apparatus.

SUMMARY OF THE INVENTION

Accordingly, it is an object of the present invention to provide a semiconductor wafer cleaning apparatus adapted to prevent a wafer surface from being stained with pollutants which are rebounded from the inside wall of a bowl during the process of rinsing the edges of the wafer.

According to an aspect of the present invention, the semiconductor wafer cleaning apparatus has a bowl with an opening and a vacuum chuck for holding and rotating a wafer, which is adapted to substantially eliminate pollutants at the edges of the wafer by supplying a rinsing solution more directly or specifically to the edges thereof, which further comprises an edge rinse member located inside said bowl for rinsing the edges of said wafer; said edge rinse member having a brush body and a brush secured to said brush body, said brush body having a U-shaped cross section; a rinsing solution supply member located in said brush body, for supplying the rinsing solution in such a manner as to flow along said brush; and means for horizontally moving said brush body between an inside of said bowl and the edges of said wafer.

In one embodiment, said brush comprises a flexible brush plate, a plurality of bristles secured on said brush plate which are adapted to be contact with said edges while said wafer is being rotated, and having a plurality of through-holes formed between said bristles.

In a preferred embodiment, said brush body further comprises a first extending space and a second extending space, each being formed along said U-shaped cross section and being isolated from one another.

In a more preferred embodiment, during rinsing the edges of said wafer, a contact width of about 1 mm is maintained between an upper surface of said wafer and said bristle, and a contact width of about 2 mm is maintained between a lower surface of said wafer and said bristles.

In a further preferred embodiment, said solution supply member comprises two rinsing supply lines which are formed to pass through said brush body and are formed to be in communication with said first extending space and said second extending space, respectively, and are adapted to spray said rinsing solution along said bristles.

In another embodiment, said rinsing solution is a solution capable of stripping a photoresist film coated on a semiconductor wafer.

In another embodiment, said means for supplying a rinsing solution to the edges of a wafer comprises an actuator using oil pressure or an electrical motor.

BRIEF DESCRIPTION OF THE ATTACHED DRAWINGS

This invention may be better understood and its object will become apparent to those skilled in the art with reference to the accompanying drawings in which.

DETAILED DESCRIPTION OF PREFERRED EMBODIMENTS

Figure 1:
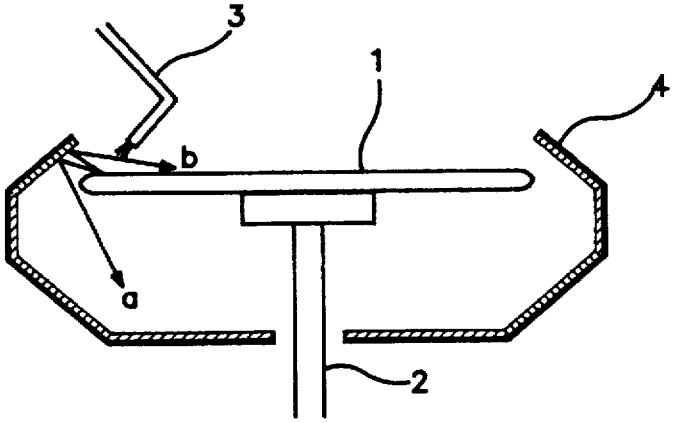
Fig. 1 prior art
FIG. 1 is a schematic view illustrating a prior art wafer cleaning apparatus.
Figure 2A:
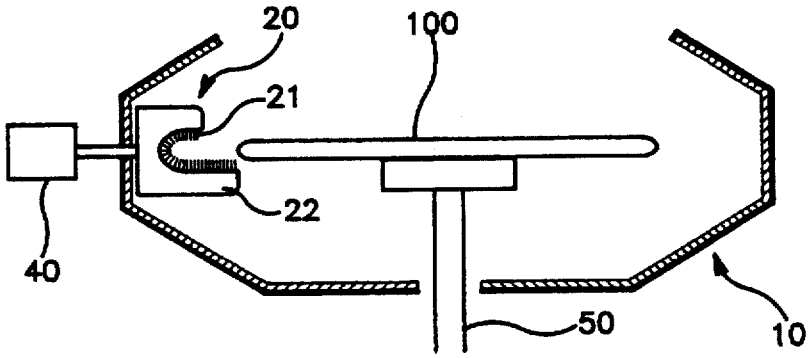
FIG. 2A is a schematic view illustrating the whole structure of a semiconductor wafer cleaning apparatus according to the present invention.

Referring to FIG. 2A, the wafer cleaning apparatus in accordance with the present invention comprises an edge rinse member 20 adapted for rinsing the edges of a semiconductor wafer 100 and a moving member 40 for horizontally moving the edge rinse member 20, in such a manner that an upper surface of the wafer can be prevented substantially from being stained with pollutants while being rinsed, said apparatus being constructed in such a manner as to substantially avoid causing the rinsing solution to rebound from the inside wall of a bowl 10 during rinsing the edges of a semiconductor wafer.

As again shown in FIG. 2A, the wafer edge rinse member 20 of the wafer cleaning apparatus is located in the bowl 10 with an opening, and has a brush body 22. The brush body 22 is provided with a U-shaped cross section capable of accepting the insertion of the edges of the wafer 100. A brush 21 is attached to the inside of the cross section.

The moving member 40 has an actuator using oil pressure or an electrical motor. The moving member 40 is adapted to permit horizontal movement of the brush body 22 from the inside of the bowl 10 to the edges of the wafer, when the wafer 100 is rotated by a vacuum chuck 50 and the edges thereof are rinsed by supplying a rinsing solution, such as a photoresist stripping solution. Also, the moving member 40 is adapted to permit movement of the brush body 22 from the edges to the inside of the bowl 10, when the rinsing of the wafer edges is completed.

Figure 2B:
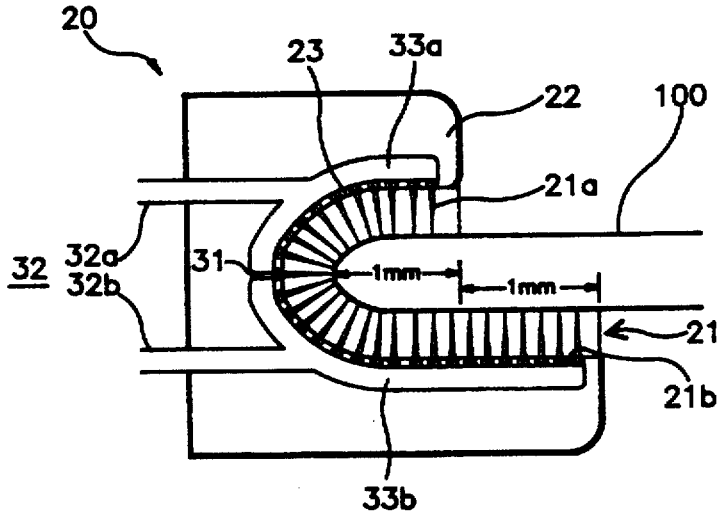
FIG. 2B is a schematic view illustrating the main portion of the wafer cleaning apparatus shown in FIG. 2A.

With reference to FIG. 2B, the brush body 22 has two extending spaces **33*a* and 33*b* which are located along the U-shaped cross section to be secured to the brush 21. Also, the wafer cleaning apparatus comprises a rinsing solution supply member 32 having two lines 32*a* and 32*b*, one of which is formed to pass through an upper portion of the brush body 22 to the extending space 33*a* and the other of which is formed to pass through a lower portion of the brush body 22 to the extending space 33*b*. The extending spaces 33*a* and 33*b* are isolated from each other by the separating tip 31. The brush 21 has a flexible plate 21*b* such as a bendable metal plate, a filling of bristles 21*a* which are secured to an upper surface of the flexible plate 21*b*, and a plurality of through-holes 23 which are formed on the flexible plate 21*b*. The through-holes 23 are formed in such a manner so as to communicate with the extending spaces 33*a* and 33*b***.

The U-shaped cross section of the brush body 22, as shown in FIG. 2B, has upper and lower end portions, one of which is longer than the other. Preferably, the lower end portion is almost twice the length of the upper end portion. Therefore, when the wafer 100 is inserted into the U-shaped cross sectional space of the brush body 22, the upper bristles **21*a* having about 1 mm in width are in contact with the upper surface of the wafer 100 while the lower bristles 21*a* having about 2 mm in width are in contact with the lower surface of the wafer 100**, as shown in FIG. 2B.

Operation of the wafer cleaning apparatus will be described hereinafter in further detail by referring to FIGS. 3A and 3B.

Figure 3A:
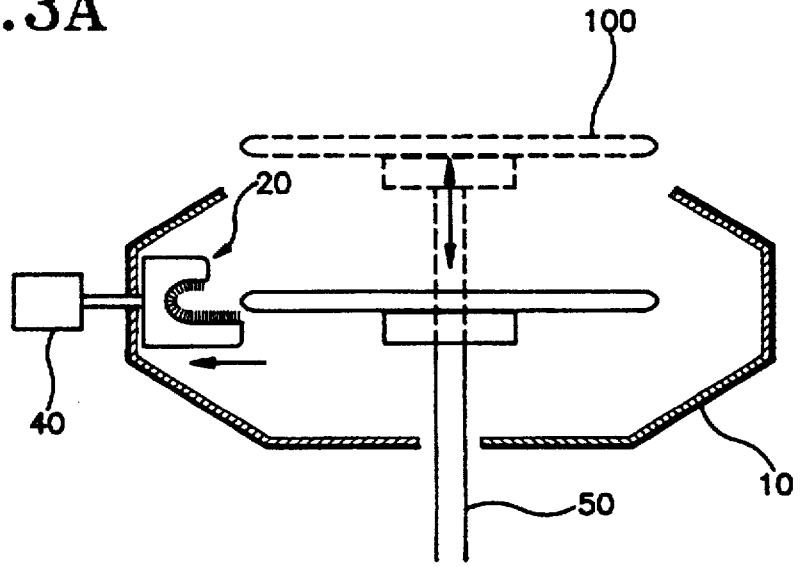
FIGS. 3A and 3B are views for illustrating the operational state of the brush body when loading or unloading of the wafer is accomplished.

First, as shown in FIG. 3A, the vacuum chuck 50 is moved upward through the opening of the bowl 10 in such a manner as to receive a semiconductor wafer 100. After the wafer 100 is loaded and fixed on the vacuum chuck 50, the vacuum chuck is permitted to return downward and to be positioned to a fixed position. When the vacuum chuck 50 is moving upward or downward, the edge rinse member 20 is located at the inside surface of the bowl 10 by means of the moving member 40 for horizontally moving the edge rinse member 20.

Figure 3B:
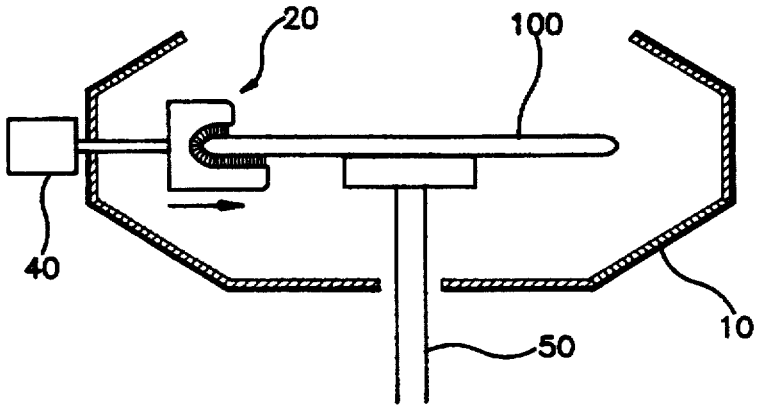

If a semiconductor wafer 100, which has been coated with photoresist thereon, is loaded on the vacuum chuck 50 and positioned at the fixed position, the step of rinsing the edges of the wafer 100 may be carried out, as shown in FIG. 3B. The wafer 100 may then be rotated, preferably at a constant speed, in accordance with the rotation of the vacuum chuck 50 to which it is attached, and at the same time the edge rinse member 20 is moved from the inside surface of the bowl 10 to edges of the wafer, in such a manner that the brush bristles **21*a* of the edge rinse member 20 are in contact with the edges thereof, that is, with the end portion of the wafer 100**, and with the neighboring portions of the upper and lower surfaces thereof.

Rinsing solution is injected into the extending spaces **33*a* and 33*b*, as shown in FIG. 2B, through the two rinsing solution supply lines 32*a* and 32*b*. The injected solution is sprayed through the through-holes 23 toward the bristles 21*a*, and then flows along the bristles. Preferably, the amount of the sprayed solution through the through-holes 23 is maintained at a constant flow rate. This is because the extending spaces 33*a* and 33*b* are provided to be isolated from each other by the separating tip 31** and the pressure being applied to each extending space is preferably maintained at a constant level.

The solution sprayed through the through-holes flows along the bristles **21*a*, and therefore the elimination of the photoresist on the edges of the wafer is assisted by contact with the bristles 21*a***.

As above described according to the present invention, a semiconductor wafer can substantially avoid being stained with pollutants, which rebound from the inside wall of a bowl during the rinsing of the edges of the wafer.

Moreover, the amount of a rinsing solution can be considerably decreased which is supplied to rinse the edges, because the solution may be maintained at a constant flow rate through the bristles of a brush to the edges of the semiconductor wafer. Also, it is possible to substantially prevent the occurrence of rebound defects which are caused by sudden variations in the pressure of the injecting solution being applied to the edges of the wafer.

Furthermore, the brush contacts only the photoresist coated on the edges of the wafer to assist the rinse solution in its cleaning of the wafer edges. Thus, the efficiency of removing photoresist film from the edges can be enhanced relative to that of a conventional wafer cleaning apparatus.

From the above description and the accompanying drawings, it is understood that various other modifications without departing from the scope and spirit of this invention will be apparent to those skilled in the art and can be readily made.

Accordingly, it is not intended that the scope of the claims appended hereto be limited to the examples of specific embodiments in the description as set forth herein. Rather, it is intended that the claims shall be construed as encompassing the features of patentable novelty that reside in the present invention, including all features that could or would be treated as equivalents thereof by those skilled in the art to which this invention pertains.

What is claimed is:

1. A semiconductor wafer cleaning apparatus having a bowl with an opening and a vacuum chuck for holding and rotating a wafer, said apparatus being adapted to minimize or to eliminate pollutants at edges of the wafer by supplying a rinsing solution substantially directly to the edges thereof, said apparatus further comprising:

an edge rinse member located inside said bowl, for rinsing the edges of said wafer;

said edge rinse member having a brush body and a brush secured to said brush body, and said brush body having a U-shaped cross section;

a rinsing solution supply member located in said brush body, adapted for supplying the rinsing solution in such a manner as to flow along said brush; and means for horizontally moving said brush body between an inside of said bowl and the edges of said wafer.

2. The wafer cleaning apparatus as defined in claim 1, wherein said brush comprises a flexible brush plate, a plurality of bristles secured on said brush plate and adapted to be located in contact with said edges while said wafer is rotated, and a plurality of through-holes formed between said bristles.

3. The wafer cleaning apparatus as defined in claim 2, wherein during rinsing the edges of said wafer, a contact width of about 1 mm is maintained between an upper surface of said wafer and said bristles, and a contact width of about 2 mm is maintained between a lower surface of said wafer and said bristles.

4. The wafer cleaning apparatus as defined in claim 3, wherein said rinsing solution is a solution for stripping a photoresist film coated on said wafer.

5. The wafer cleaning apparatus as defined in claim 1, wherein said brush body further comprises a first extending space and a second extending space, said spaces being formed along said U-shaped cross section and being isolated from each other.

6. The wafer cleaning apparatus as defined in claim 5, wherein said solution supply member comprises two rinsing supply lines which are formed to pass through said brush body and formed in a manner adapted to be in communication with said first extending space and said second extending space, respectively, and adapted to spray said rinsing solution along said bristles.

7. The wafer cleaning apparatus as defined in claim 6, wherein said rinsing solution is a solution for stripping a photoresist film coated on said wafer.

8. The wafer cleaning apparatus as defined in claim 1, wherein said rinsing solution is a solution for stripping a photoresist film coated on said wafer.

9. The wafer cleaning apparatus as defined in claim 1, wherein said means comprises an actuator using oil pressure.

10. The wafer cleaning apparatus as defined in claim 1, wherein said means comprises an actuator using an electrical motor.

* * * * *